US009643757B2

(12) United States Patent
Smyers et al.

(10) Patent No.: US 9,643,757 B2
(45) Date of Patent: May 9, 2017

(54) METHOD OF MERCHANDISING LIDS AND VESSELS

(71) Applicant: WKI Holding Company, Inc., Rosemont, IL (US)

(72) Inventors: Justin Smyers, Newport Beach, CA (US); Nicolsson Fernandes, Ontario (CA); Steven M. Grider, West Dundee, IL (US); Ken S. Tran, West Covina, CA (US)

(73) Assignee: WKI Holding Company, Inc., Rosemount, IL (US)

( * ) Notice: Subject to any disclaimer, the term of this patent is extended or adjusted under 35 U.S.C. 154(b) by 0 days.

(21) Appl. No.: 14/751,029

(22) Filed: Jun. 25, 2015

(65) Prior Publication Data

US 2015/0291323 A1 Oct. 15, 2015

Related U.S. Application Data

(62) Division of application No. 13/754,773, filed on Jan. 30, 2013.

(Continued)

(51) Int. Cl.
*B65D 41/16* (2006.01)
*B65D 41/18* (2006.01)

(Continued)

(52) U.S. Cl.
CPC ..... *B65D 43/02* (2013.01); *B65D 21/0223* (2013.01); *B65D 43/0212* (2013.01); *B65D 43/26* (2013.01); *B65D 45/02* (2013.01); *B65D 45/18* (2013.01); *B65D 53/00* (2013.01); *G06Q 99/00* (2013.01); *B65D 53/06* (2013.01);

(Continued)

(58) Field of Classification Search
CPC .. B65D 43/065; B65D 43/06; B65D 43/0212; B65D 53/06; B65D 53/00; B65D 45/04; B65D 45/16; B65D 45/18; B65D 45/22; B65D 2543/0099; B65D 2543/00953; B65D 2543/00564; F16J 15/3456; F16J 15/34; F16J 9/06; F16J 15/02; F16J 15/22; F16J 15/104; F01D 11/005; F16D 3/84; B60J 10/27
USPC ..... 220/780, 784, 795, 228, 378, 217, 221, 220/224, 233, 234, 238, 849; 277/306, 277/307, 469, 590, 628, 630, 644, 648
See application file for complete search history.

(56) References Cited

U.S. PATENT DOCUMENTS 5,799,792 A * 9/1998 Abrums ..... B65D 21/0233 206/501
7,029,013 B2 * 4/2006 Yajima ..... F16J 15/025 206/710

(Continued)

*Primary Examiner* — Jeffrey Shapiro
(74) *Attorney, Agent, or Firm* — Larry K. Roberts

(57) ABSTRACT

In one embodiment, a lid structure with latches is configured for sealing use with container vessels of different materials having differing manufacturing dimensional tolerances, such plastic vessels and glass vessels. Another feature of a lid and vessel combination is the provision of a lid receptacle feature, configured to capture the base of a vessel in a stacking arrangement, without utilization of special features on the vessel base. A method of merchandising lids and vessels is described, wherein a lid is provided for separate purchase, a plurality of vessels of different materials is provided for separate purchase which are configured to match to the lid.

12 Claims, 18 Drawing Sheets

Related U.S. Application Data

(60) Provisional application No. 61/609,142, filed on Mar. 9, 2012.

(51) Int. Cl.

| | |
|---|---|
| ***B65D 43/02*** | (2006.01) |
| ***B65D 53/00*** | (2006.01) |
| ***B65D 21/02*** | (2006.01) |
| ***B65D 45/18*** | (2006.01) |
| ***B65D 43/26*** | (2006.01) |
| ***B65D 45/02*** | (2006.01) |
| ***G06Q 99/00*** | (2006.01) |
| *B65D 53/06* | (2006.01) |

(52) U.S. Cl.

CPC ..... *B65D 2543/00027* (2013.01); *B65D 2543/0074* (2013.01); *B65D 2543/0099* (2013.01); *B65D 2543/00194* (2013.01); *B65D 2543/00296* (2013.01); *B65D 2543/00527* (2013.01); *B65D 2543/00537* (2013.01); *B65D 2543/00564* (2013.01); *B65D 2543/00629* (2013.01); *B65D 2543/00685* (2013.01); *B65D 2543/00805* (2013.01); *B65D 2543/00842* (2013.01); *B65D 2543/00953* (2013.01)

(56) References Cited

U.S. PATENT DOCUMENTS

| | | | | |
|---|---|---|---|---|
| 9,108,776 | B2 * | 8/2015 | Smyers | B65D 53/00 |
| 2002/0195455 | A1 * | 12/2002 | Takahashi | B65D 53/02 220/806 |
| 2005/0139604 | A1 * | 6/2005 | Kim | B65D 1/40 220/788 |
| 2006/0249512 | A1 * | 11/2006 | Ueda | H01L 21/67376 220/378 |
| 2009/0008284 | A1 * | 1/2009 | Lown | B65D 43/0212 206/457 |
| 2009/0115598 | A1 * | 5/2009 | Carlson, Jr. | A61J 7/0472 340/526 |
| 2009/0206001 | A1 * | 8/2009 | Sasaki | H01L 21/67376 206/711 |
| 2010/0237070 | A1 * | 9/2010 | Coonce | B65D 81/2038 220/203.29 |
| 2011/0031705 | A1 * | 2/2011 | Peddle | B65D 53/02 277/650 |
| 2012/0273488 | A1 * | 11/2012 | Kim | B65D 81/2038 220/203.29 |
| 2013/0233854 | A1 * | 9/2013 | Smyers | B65D 53/00 220/240 |

* cited by examiner

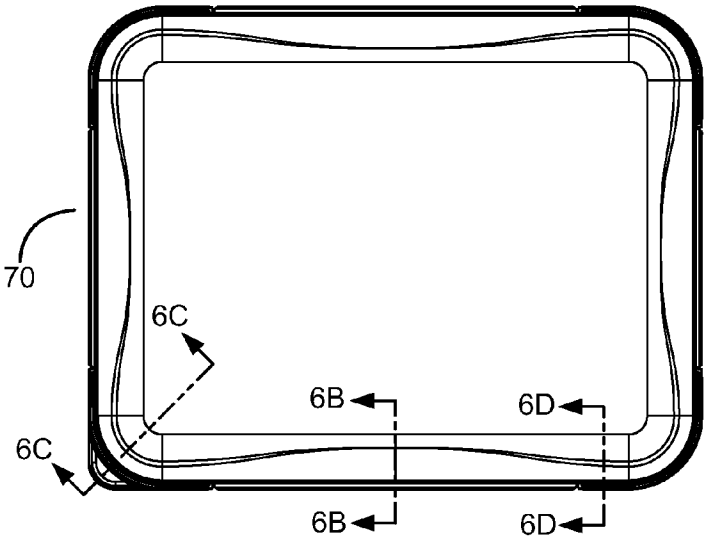
FIG. 6A
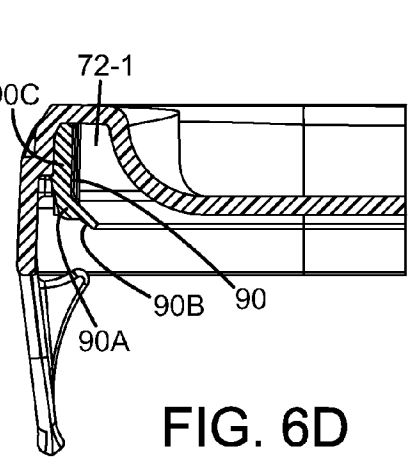
FIG. 6C
FIG. 6D
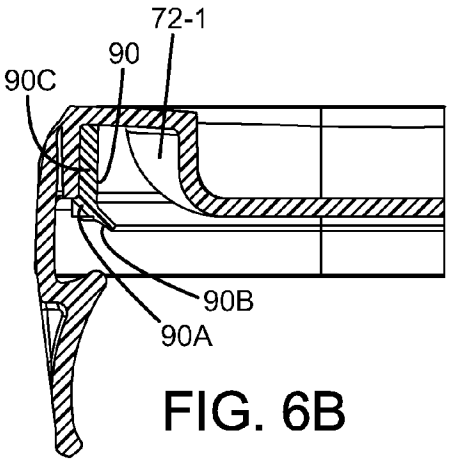
FIG. 6B

FIG. 11A
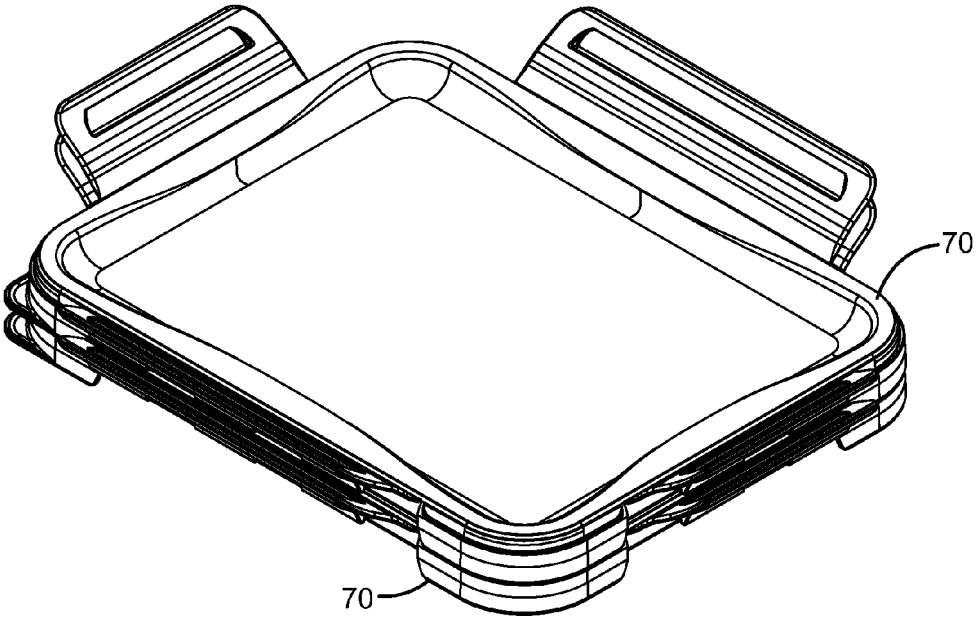
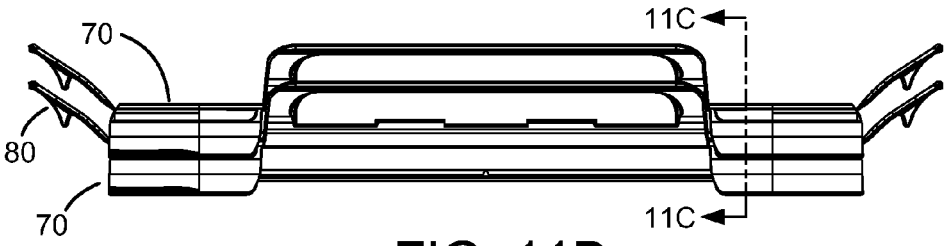
FIG. 11B
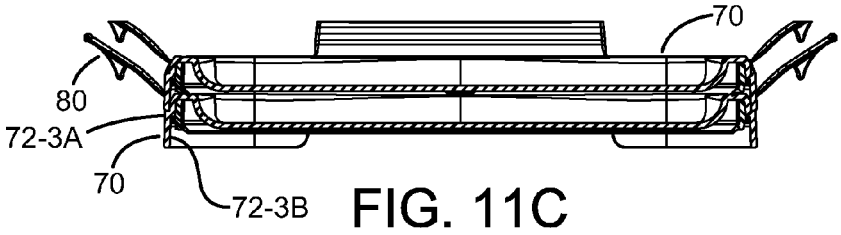
FIG. 11C

FIG. 12A
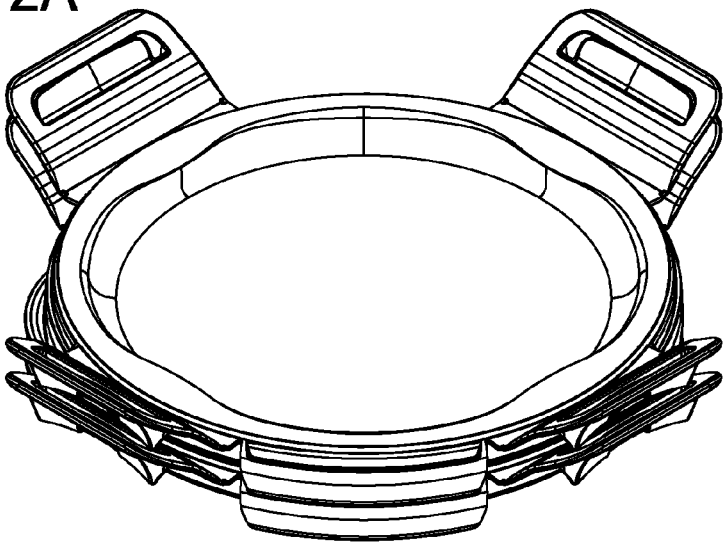
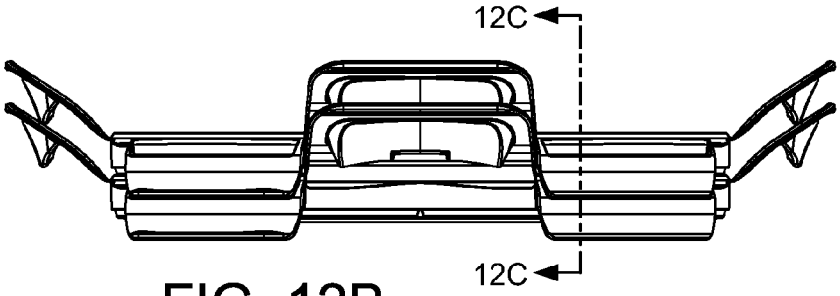
FIG. 12B
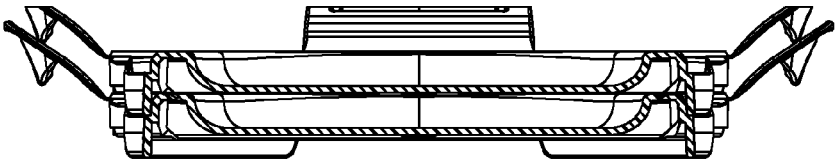
FIG. 12C

METHOD OF MERCHANDISING LIDS AND VESSELS

CROSS-REFERENCE TO RELATED APPLICATION

This application is a divisional application of application Ser. No. 13/754,773, filed Jan. 30, 2013, which in turn claims priority to U.S. Provisional patent application 61/609,142, filed Mar. 9, 2012, and entitled "Lid, and Container System and Lid," the entire contents of which applications are incorporated herein by this reference.

BACKGROUND

Vessels for holding food items may include a separate lid, but are often not provided with an air-tight seal. This is particularly the case for glass vessels for example. Air-tight container-lid systems are typically fabricated from a rigid plastic material, and typically utilize a separate seal member disposed between the lid and container.

BRIEF DESCRIPTION OF THE DRAWINGS

Features and advantages of the disclosure will readily be appreciated by persons skilled in the art from the following detailed description when read in conjunction with the drawing wherein:

FIGS. 2A and 2C are respective cross-sectional views taken through lines 2B-2B and 2C-2C of FIG. 2A.

FIG. 6A is a top view of the lid structure of the system of FIG. 1A. FIGS. 6B, 6C and 6D are respective cross-sectional views taken along lines 6B-6B, 6C-6C and 6D-6D of FIG. 6A.

FIG. 11A is an isometric view of an exemplary embodiment of a set of lids as in the system of FIG. 1 A, in which the lids are in a lid stacking arrangement. FIG. 11B is an end view of the stacked lids of FIG. 11A. FIG. 11C is a cross-section view taken along line 11C-11C of FIG. 11B.

FIG. 12A is an isometric view of an exemplary embodiment of a set of lids for a circular container configuration, arranged in stacking relation. FIG. 12B is a side view of the stacked lids of FIG. 12A. FIG. 12C is a cross-section view of the stacked configuration of FIG. 12B, taken along line 12C-12C of FIG. 12B.

DETAILED DESCRIPTION

Figure 1A:
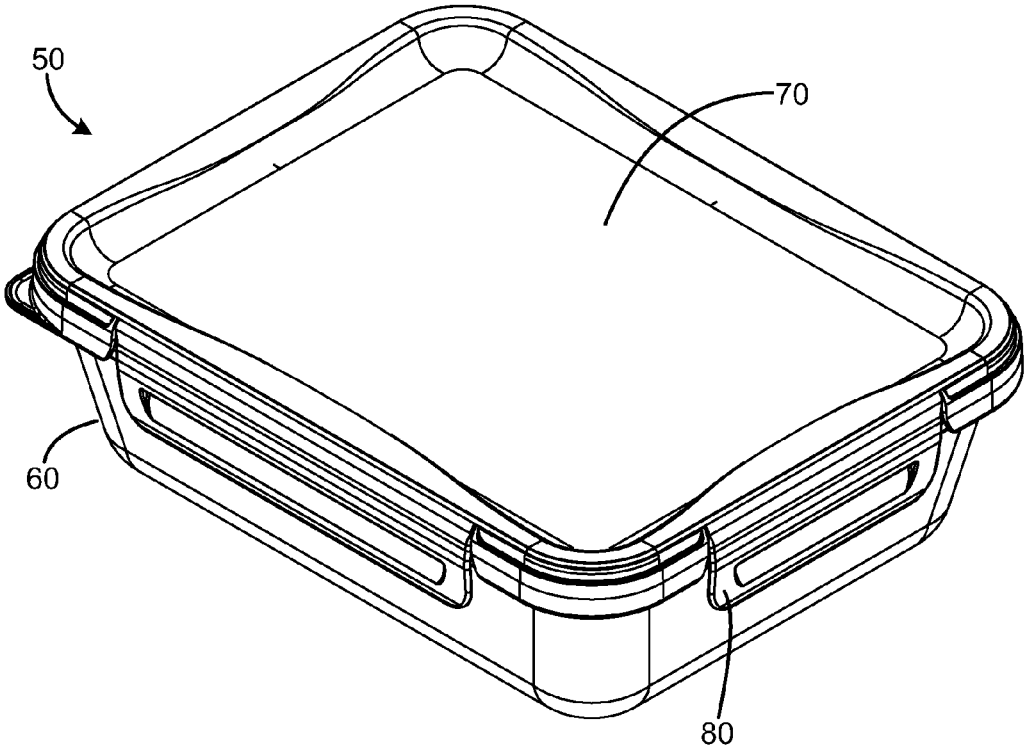
FIG. 1A is an isometric view of an exemplary embodiment of a container and lid system, in which the container is fabricated of a glass material.
Figure 1B:
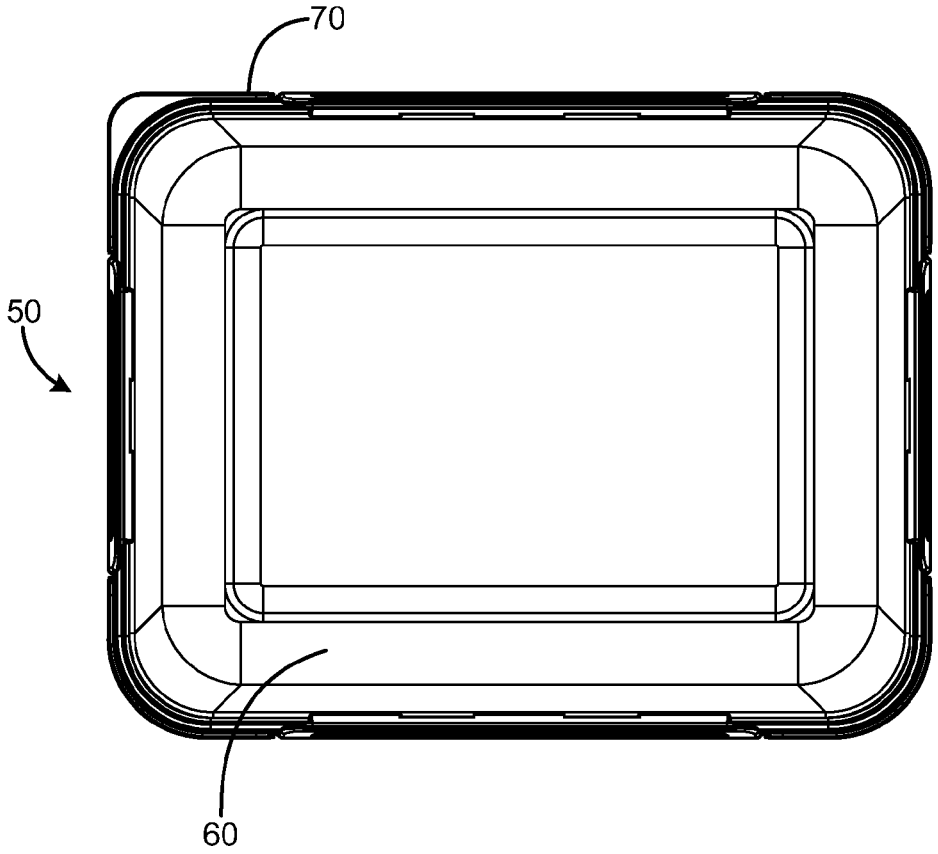
FIGS. 1B and 1C are respective bottom and end views of the container and lid system of FIG. 1A.
Figure 1C:
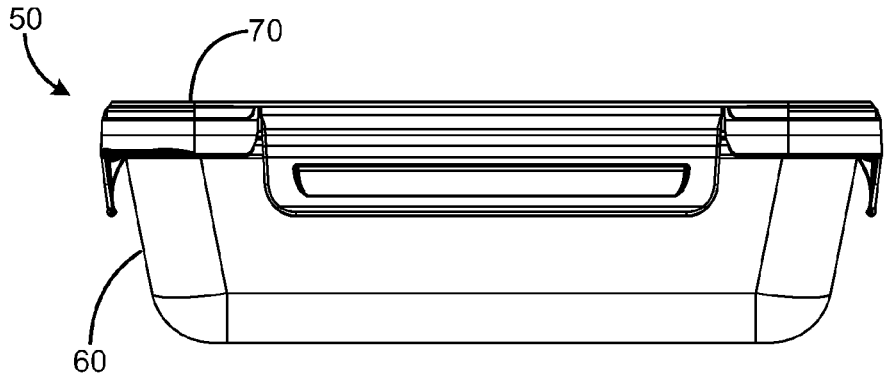

In the following detailed description and in the several figures of the drawing, like elements are identified with like reference numerals. The figures may not be to scale, and relative feature sizes may be exaggerated for illustrative purposes.

In accordance with one aspect, a lid structure with latches is configured for sealing use with container vessels of different materials having differing manufacturing dimensional tolerances, e.g. plastic, metal, glass and ceramic vessels. Plastic vessels can typically be manufactured to tighter tolerances than vessels of other materials such as glass and ceramic. For example, a glass or ceramic vessel may have a flat circumferential seal surface, whose flatness has a certain dimensional tolerance. Plastic or metal vessels can be manufactured with tighter tolerances, so that a similar flat circumferential seal surface can be expected to seal to a lid with greater seal effectiveness than can the glass or ceramic vessel. A lid with capability for use on a plurality of vessel types, i.e. a universal lid, provides significant advantages. For example, the lid may be sold to consumers separately from the vessel, allowing the user to purchase a separately sold vessel to be used with the lid. This provides the consumers with the capability to choose the vessel which best meets his or her needs, while still being able to use the same lid. Another advantage is that the number of types of lids which must be held in inventory by a merchandiser is reduced, since the same lid can be used with multiple types of vessels. Costs of production may be reduced, due to increased scale of production.

In accordance with another aspect, a lid configuration is provided with capability of stacking multiple lids together and with interference fitting of the adjacent lids, for maintaining the lid stack in place.

Another aspect is a lid and vessel configured to provide the capability of stacking the vessel on top of the lid, with an interference fit of lid features to the base of the vessel.

An exemplary embodiment of a vessel-lid combination includes a glass, ceramic, metal or plastic vessel having an open top surrounded by a peripheral edge, a lid fabricated of a plastic material, and a seal structure integrated with the lid to form a unitary structure. The lid is configured to attach to the open top by means of a latch or set of latches integrated with the lid, and the seal structure is configured to provide a substantially air-tight seal between the lid and the peripheral edge of the vessel when the lid is attached to the vessel.

In one exemplary embodiment, the vessel is a container fabricated of a glass suitable for baking or oven heating applications. In another embodiment, the vessel is fabricated of a plastic material such as polypropylene. In a general sense the vessel could be any container with a suitable locking lip to engage the lid latches, including plastic, ceramic, metal, glass or other containers. In an exemplary embodiment, a lid is configured for use on different vessels fabricated from dissimilar materials and with different manufacturing tolerances.

FIGS. 1A-7B illustrate an exemplary embodiment of a vessel and lid system 50, which includes a vessel 60 and a lid 70 with an integral seal structure and latches 80. The vessel 60 in one embodiment is a glass container, which may be suitable for heating or baking food items in a hot oven. In this embodiment, the vessel 60 is made from a material which can withstand oven temperatures and cooling stresses. Other types of glass, metal, ceramic or plastic vessels can be configured for use with the lid 70, such that the vessels are formed with a sealing edge and latch engagement lip, as described more fully below.

Figure 2B:
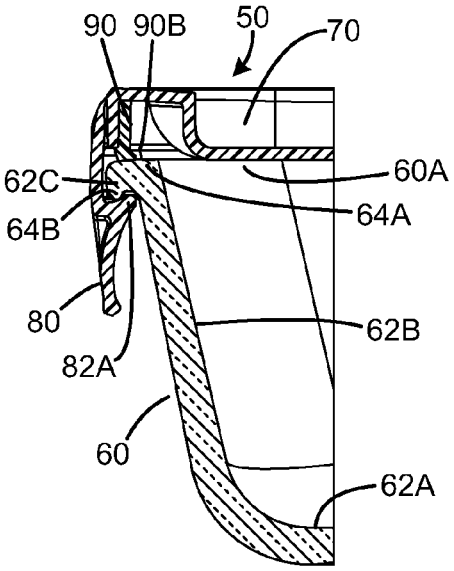
Figure 2C:
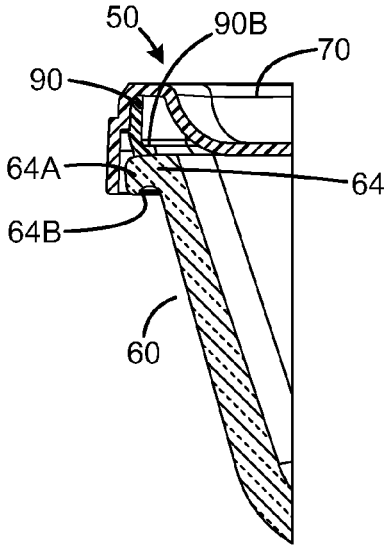
Figure 2A:
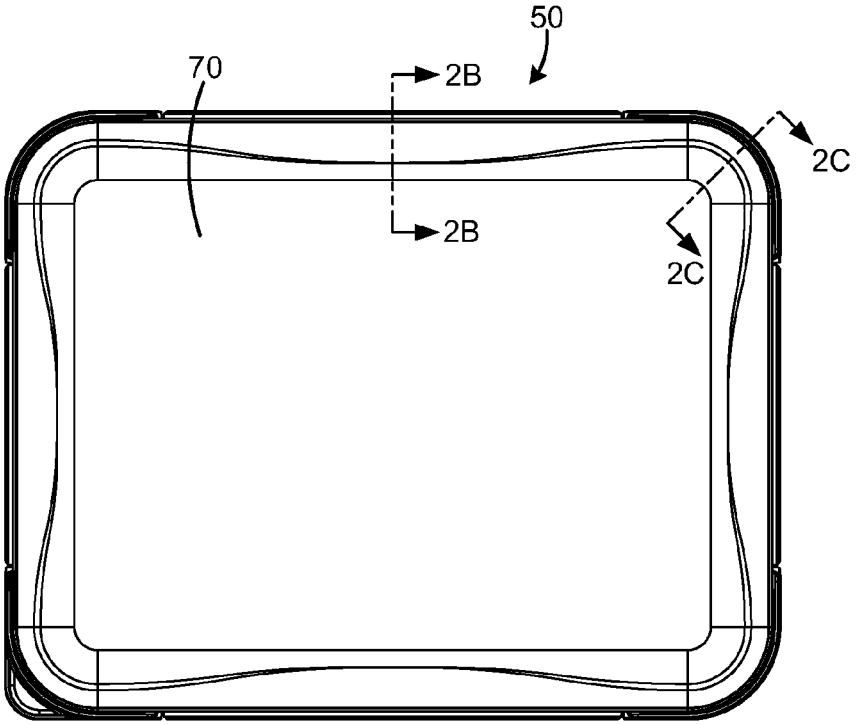
FIG. 2A is a top view of the container and lid system of FIG. 1A.
Figure 2D:
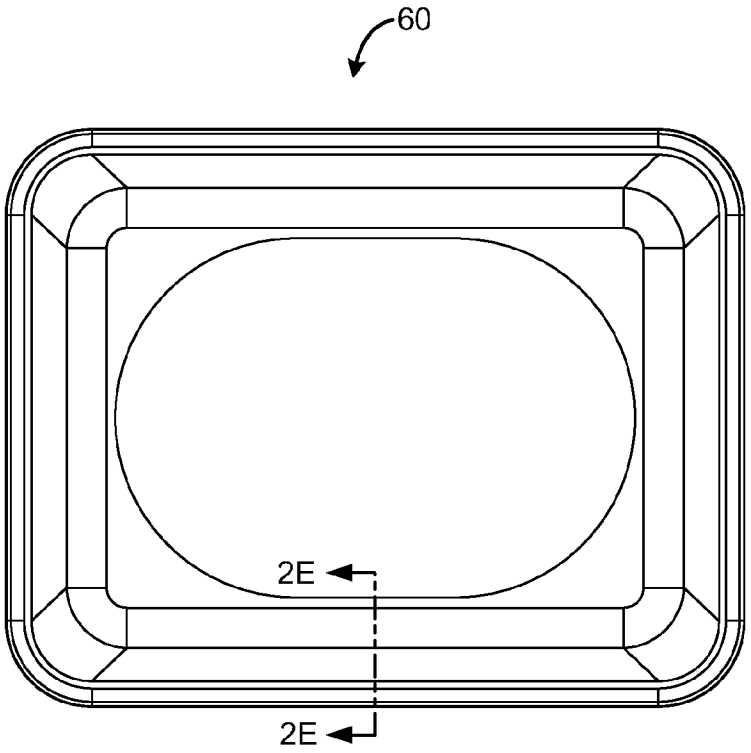
FIG. 2D is a top view of an exemplary embodiment of a glass vessel as in the system of FIG. 1A.

The cross-sectional views of FIGS. 2B and 2C illustrate the construction of the exemplary vessel 60 in further detail. The vessel 60 is a unitary structure, having an open top region 60A, defined by a bottom portion 62A, a sidewall portion 62B and a peripheral rim portion 64. A sealing edge portion 62C is defined by the sidewall portion at or adjacent the open top region. In this example, the sidewall portion 62B is angled outwardly from the bottom region, defining a 13.5 degree angle relative to the bottom portion. This particular angular arrangement is but one example, other configurations of the sidewall and bottom portions of the vessel may alternately be employed. The rim portion 64 includes a generally flat top edge portion 64A and a latch engagement lip portion 64B.

The lid 70 is attached to the vessel 60 and latched in place to cover the open vessel top, using latches 80 connected by living hinges to the lid proper on opposite sides of the lid. The latches have latch hook features 82A which engage the latch engagement lip portion 64B of the vessel when the lid is placed on the vessel and the latches rotated about the hinges to the latched position shown in FIGS. 1A and 2B, for example. A seal structure 90, discussed more fully below, engages a seal surface on the vessel, the top edge portion 64A, as the lid is latched in place.

The lid 70 in an exemplary embodiment is fabricated by injection molding using a two shot molding technique, in which a first shot structure is fabricated of a first plastic material, and then the lid structure is completed in a second shot in which a second plastic material is overmolded to a portion of the first shot structure to form the seal structure 90. The second plastic material is bonded to surfaces of the first shot material as a result of the molding process. FIGS. 3A-3D illustrate an exemplary embodiment of the first shot structure 70-1 of the lid 70. In an exemplary embodiment, the primary, first shot lid structure is formed from a polymer such as polypropylene or similar structurally rigid polymer material. FIG. 3D also illustrates that the latch 80 in the downward, latched condition, is recessed relative to the lid outer skirt, so that the latch and hinge do not protrude outwardly from the lid skirt, thus offering some protection against damage to the latch.

FIGS. 4 and 5A-5C illustrate an exemplary embodiment of the second shot structure, the seal structure 90, in isolation. An exemplary over-mold material used in the second shot is a thermoplastic elastomer (TPE) material. By fabricating the seal structure in this manner using an overmold, second shot process, several advantages are obtained, including lower cost relative to a separate, removable seal, cleanliness (by avoiding space between a removable seal and the lid structure), and ease of use since the seal structure is permanently attached to the first shot structure.

FIGS. 6A-6D illustrate an exemplary embodiment of the lid 70 in a completed form, i.e. after the overmolding process is completed to form the second plastic material to the first shot structure and define the seal structure 90. In an exemplary embodiment, the first shot lid structure defines a peripheral channel 72-1 between a peripheral downwardly extending skirt portion 72-3 and an inner peripheral wall structure 72-2, connected by a web portion 72-4. The second shot material of the seal structure 90 in this embodiment is molded to the interior side wall 72-3A (FIG. 3B) of the skirt portion and to the web portion. In an exemplary embodiment, the second shot material does not fill the channel, but in other embodiments, the second shot material may fill a larger part or all the channel if desired for a particular application.

Figure 9B:
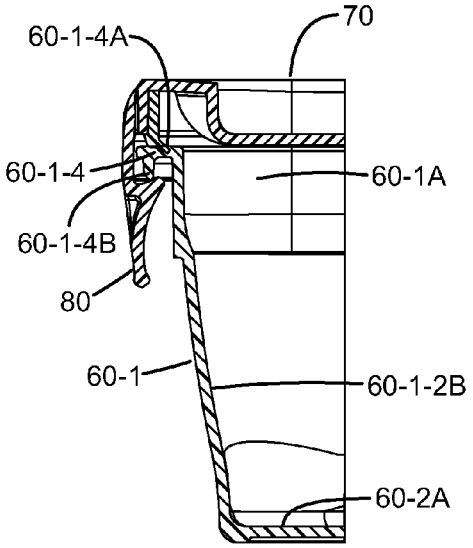
FIGS. 9B and 9C are respective cross-sectional views taken through lines 9B-9B and 9C-9C of FIG. 9A.
Figure 9C:
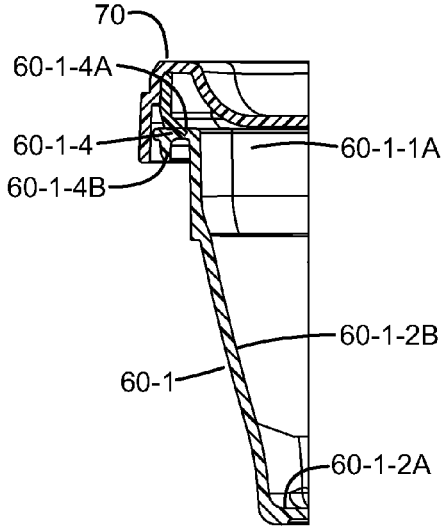
Figure 9A:
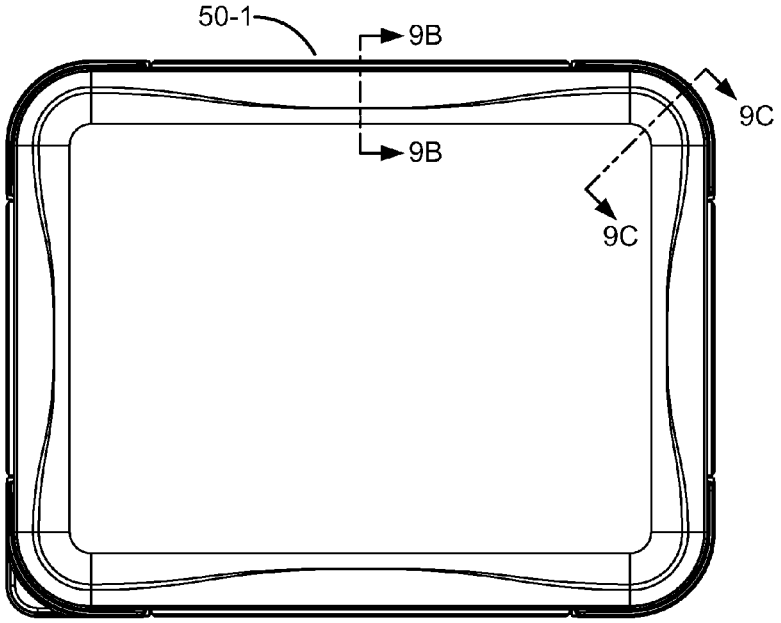
FIG. 9A is a top view of the container and lid system of FIG. 8A.
Figure 10A:
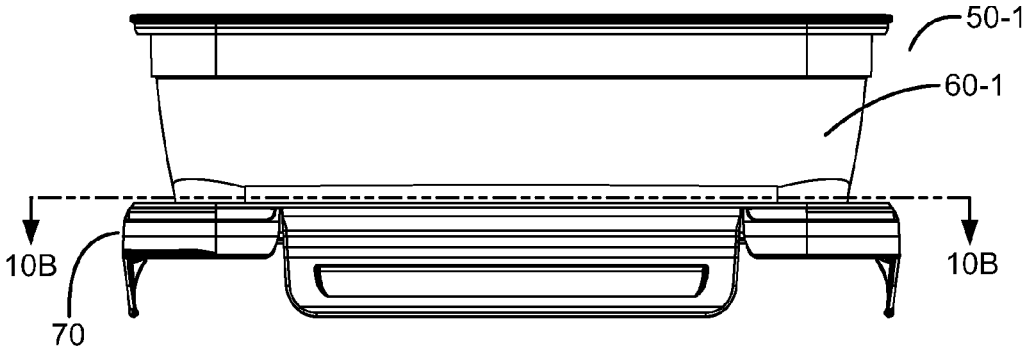
FIG. 10A is a side view illustrating a stacking arrangement of a container lid system as in FIG. 8A, with the container in a stacking arrangement on a lower lid.
Figure 10B:
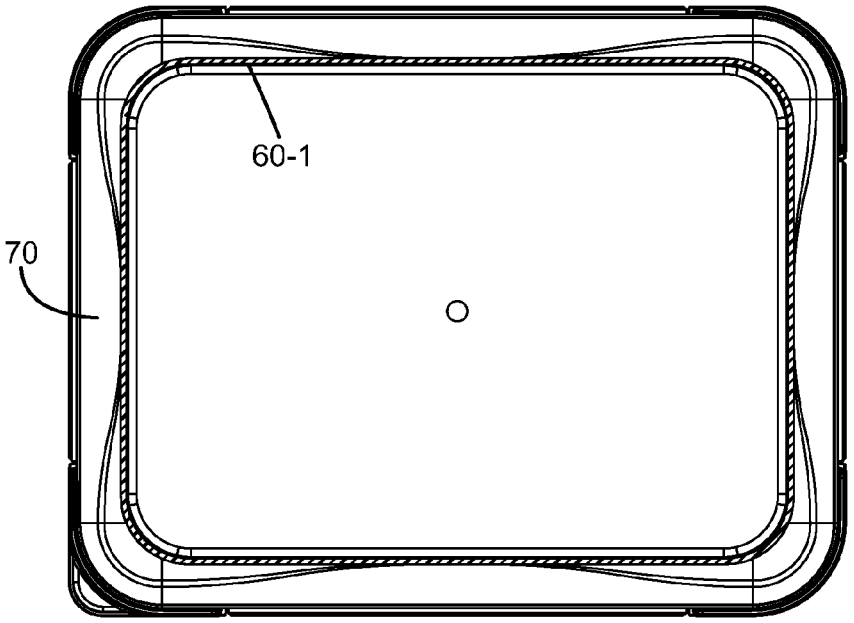
FIG. 10B is a cross-sectional view taken along line 10B-10B of FIG. 10A.

The seal structure 90 in this embodiment comprises several portions. A main body portion 90C is attached to the inner wall of the skirt and to the web portion. Another seal portion is a protruding spring portion 90B. Another seal portion is compression portion 90A. For use with glass vessels, a feature is that the seal structure is configured to absorb the greater flatness variability in the sealing area or surface of the glass vessel. The spring portion 90B of the seal structure is configured to flex easily to absorb the variability of the vessel seal surface, while the compression portion 90A extends below the skirt portion by a sufficient distance to compress in response to latch closure and provide adequate latch retention force to hold the lid latches in the closed position. The flexing of the spring portion is illustrated in FIGS. 2B and 2C, in the case of a glass vessel 60 with the lid 70. FIGS. 9B and 9C illustrate a plastic vessel with the lid 70.

In an exemplary embodiment, the spring seal portion 90B is a finger-like protrusion, angled inwardly toward the interior portion of the lid. In other embodiments, the spring seal portion may be angled outwardly, away from the lid interior. Other suitable configurations for the spring portion may be employed, such as a rib downwardly extending from the compression portion, or an elbow-shaped cross-section configuration. Exemplary dimensions of the spring portion for one embodiment are a height dimension on the order of 0.04 to 0.05 inch, and a thickness of 0.025 to 0.040 inch. Exemplary dimensions for the compression portion are a thickness of about 0.10 inch and a height varying from about 0.085 to 0.15 inch, depending on the location around the perimeter. An exemplary overall height dimension for the seal structure is 0.35 inch, for an exemplary embodiment.

FIGS. 8A-10B illustrate another vessel and lid system 50-1, in which the lid 70 is used in combination with a plastic vessel 60-1. The vessel 60-1 is a unitary structure, having an open top region 60-1-1A, defined by a bottom portion 60-1-2A, a sidewall portion 60-1-2B and a peripheral rim portion 60-1-4. In this example, the sidewall portion 60-1-2B is angled outwardly from the bottom region, defining an 8 degree angle relative to the bottom portion, which is typically variable for different vessel sizes and configurations. This particular angular arrangement is but one example, other configurations of the sidewall and bottom portions of the vessel may alternately be employed. The rim portion 60-1-4 includes a generally flat top edge portion 60-1-4A and a latch engagement lip portion 60-1-4B.

The lid latching and sealing structures interact with the vessel 60-1 in a manner similar to that described above regarding the glass vessel 60. The flat top edge portion 60-1-4A of the plastic vessel may be flatter than the corresponding seal surface of the glass vessel.

Figure 7A:
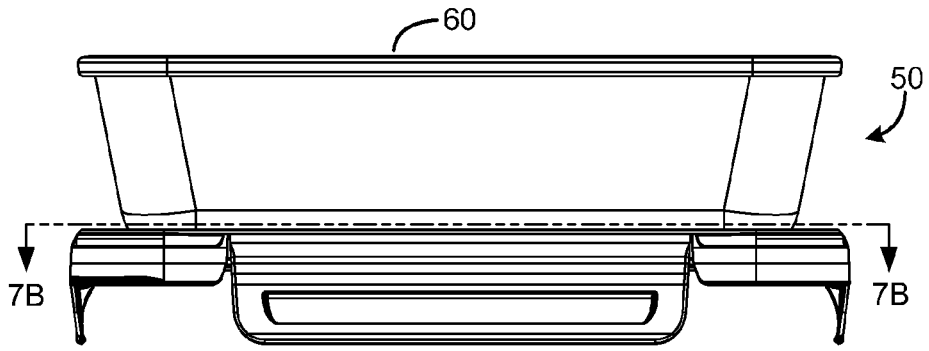
FIG. 7A is a side view of a container/lid system as in FIG. 1A, in which a container is in a stacking relationship to a lower lid.
Figure 7B:
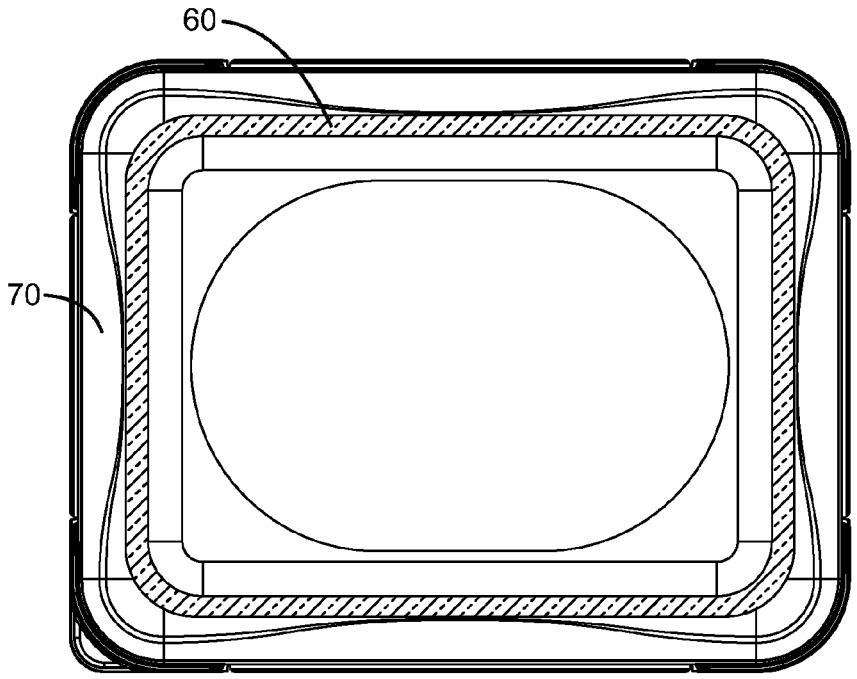
FIG. 7B is a cross-sectional view taken along line 7B-7B of FIG. 7A.
Figure 8A:
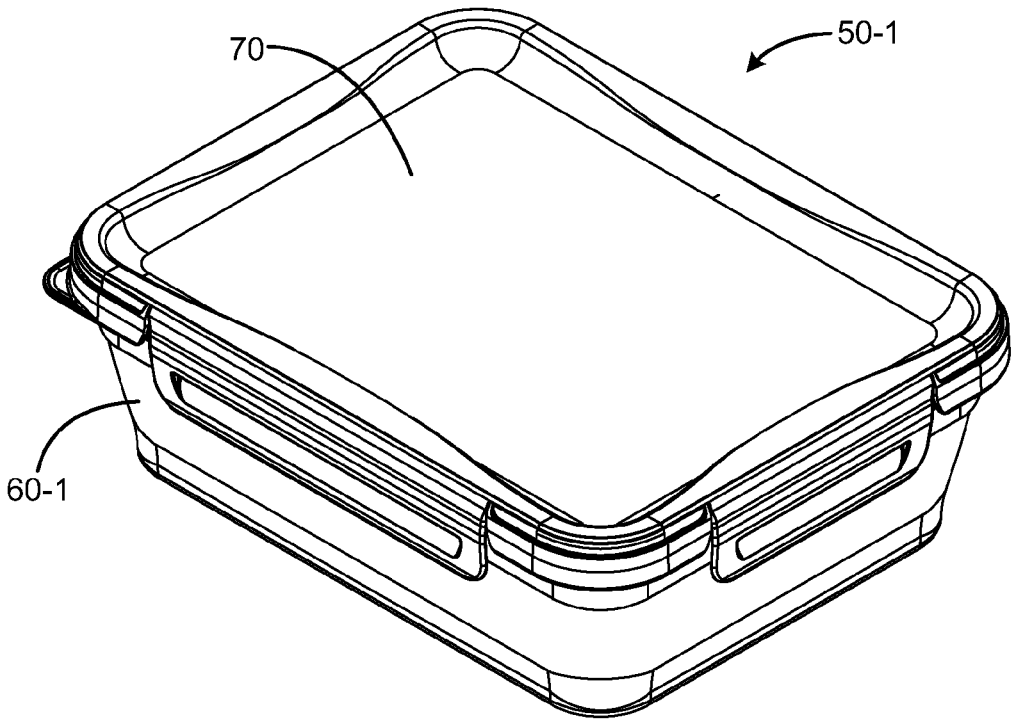
FIG. 8A is an isometric view of an exemplary embodiment of a container and lid system, in which the container is fabricated of a plastic material, and the lid is as described above regarding FIGS. 2A-7B.
Figure 8B:
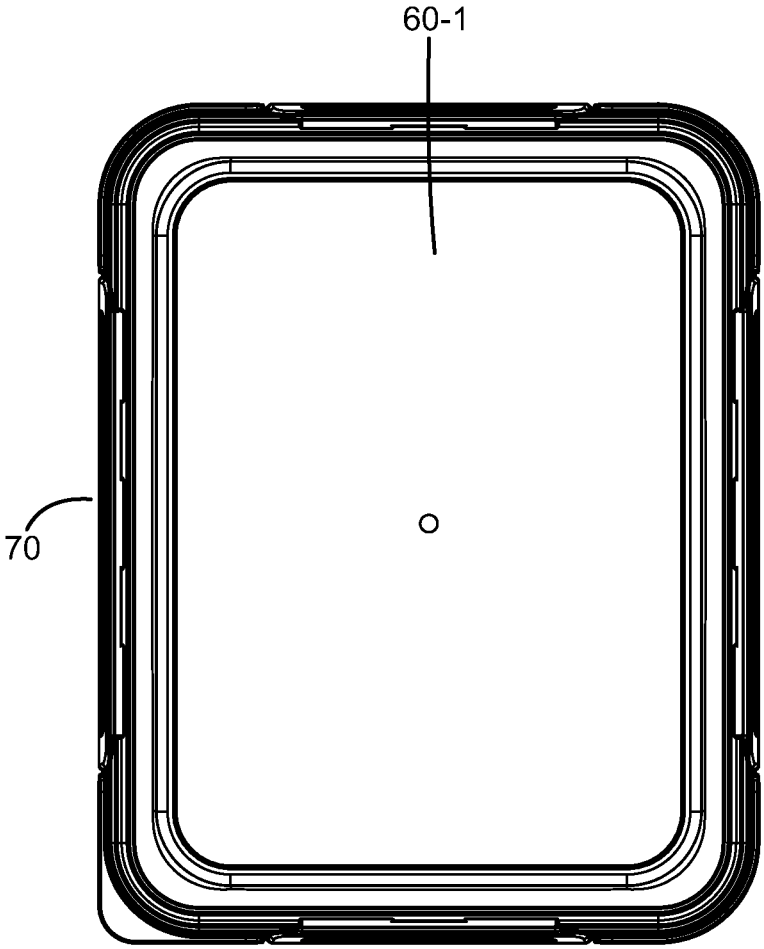
FIGS. 8B and 8C are respective bottom and front views of the container and lid system of FIG. 8A.
Figure 8C:
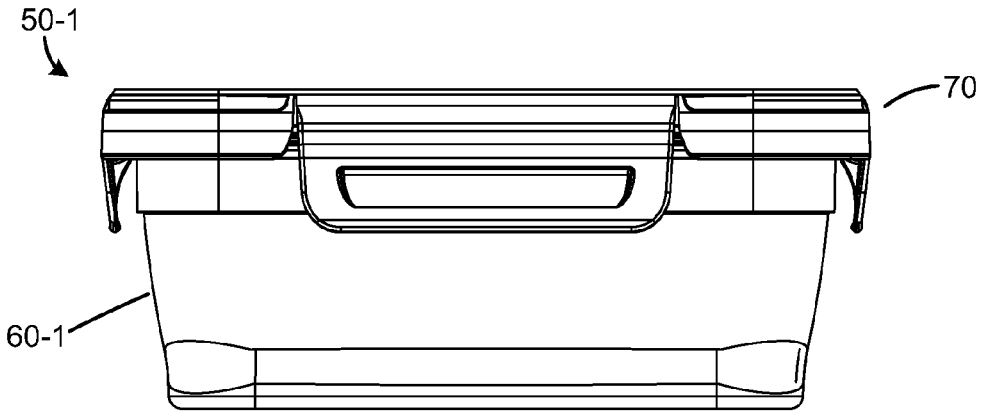

Another feature of a lid and vessel combination is the provision of a lid receptacle feature, configured to capture the base of a vessel in a stacking arrangement, without utilization of special features on the vessel base. The stacking is illustrated in FIGS. 7A and 7B for a glass vessel 60, and in FIGS. 10A-10B for a plastic vessel 60-1.

Figure 3A:
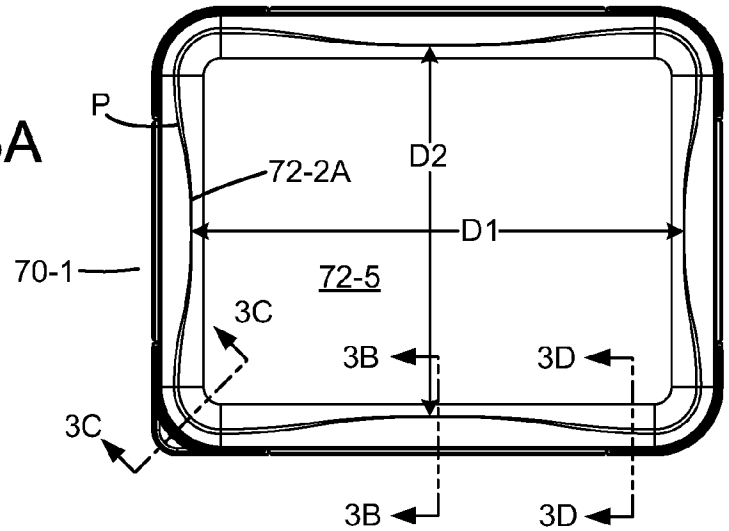
FIG. 3A is a top view of an exemplary embodiment of a first shot structure of a lid structure of the system of FIG. 1A.
Figure 3D:
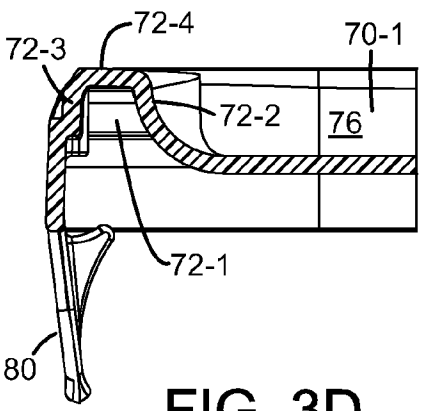
FIGS. 3B, 3C and 3D are respective cross-sectional views taken through lines 3B-3B, 3C-3C and 3D-3D of FIG. 3A.
Figure 3C:
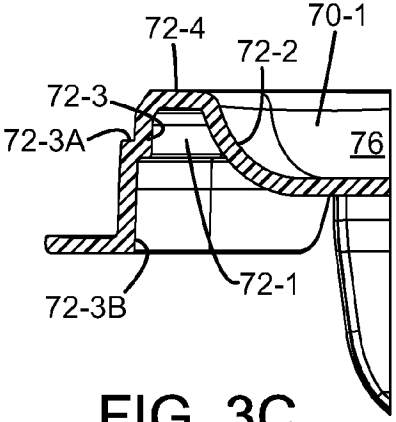
Figure 3B:
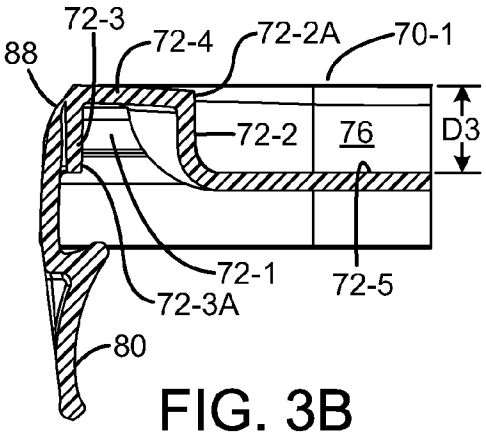
Figure 4:
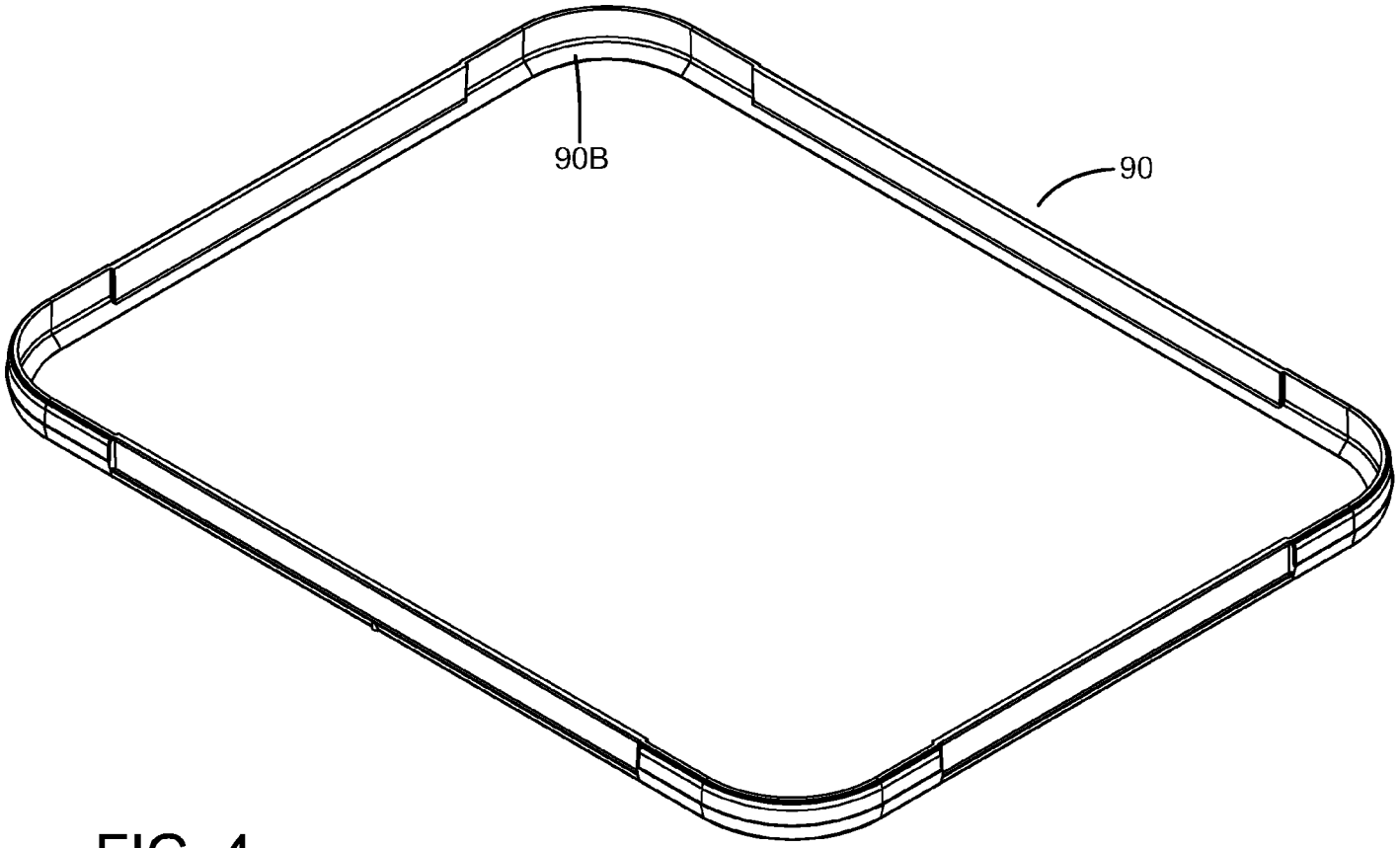
FIG. 4 is an isometric view of an exemplary embodiment of a second shot structure, a seal structure portion, of the lid structure of FIG. 1A.
Figure 5A:
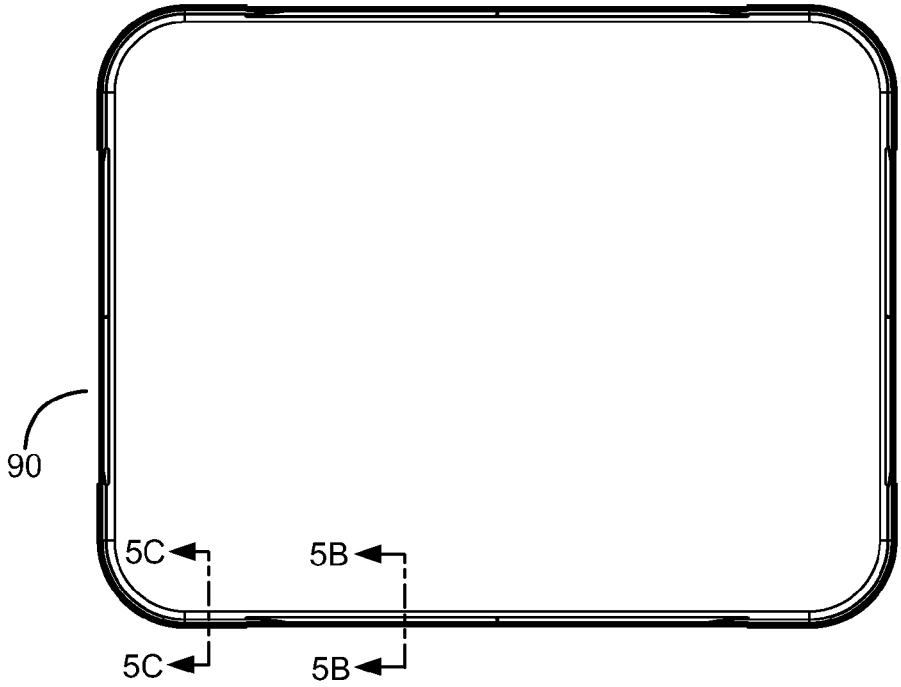
FIG. 5A is a top view of the second shot portion of FIG. 4.
Figure 5B:
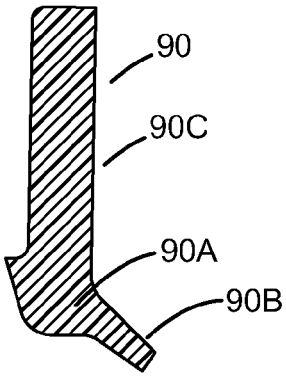
FIGS. 5B and 5C are respective cross-sectional views of the second shot structure of FIG. 5A.
Figure 5C:
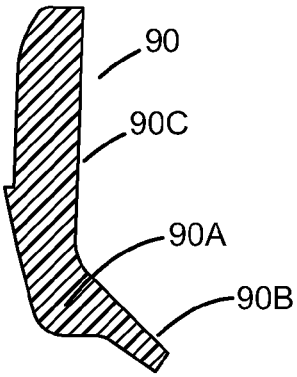

The receptacle feature of the lid 70 is illustrated, for example, in FIGS. 3A-3C. The inner wall 72-2 and lid web portion 72-5 connected to the inner wall define a recess or receptacle region 76. The receptacle region has a depth D3. The top edge 72-2A of the inner wall 72-2 defines a closed generally rectangular periphery P (FIG. 3A). However, the periphery P in the areas intermediate the lid corners is defined by length dimension D1 and width dimension D2 which are somewhat smaller than the same length dimension measured at the corners of the lid. The inner wall 72-2 may be vertical or inclined inwardly at the intermediate regions. The dimensions D1 and D2 are selected in combination with the dimensions of the base of vessels such as 60 and 60-1. In the case of glass or ceramic vessels, the lid is designed with enough clearance to allow the glass vessel (such as vessel 60) to enter and sit in the receptacle without interference. In the case of a plastic vessel, such as vessel 60-1, the lid is designed to create an interference fit between the periphery P and the side walls of the vessel when the vessel is placed over the receptacle 76 and pressed down into the receptacle. In the case of a plastic vessel, both the vessel base and the lid wall may flex sufficiently to allow the vessel base to be seated in the receptacle 76.

This lid-vessel stacking may be employed to stack two or more of the vessel-lid systems while securely preventing lateral movement of an upper system relative to a lower system. Moreover, this can be achieved without special features in the base of the vessel. The vessel walls adjacent the base may be vertical or closer to vertical in the areas of interference with the lid, and with the angle relative to vertical increasing above the areas of interference.

Another feature of an embodiment of the lid 70 is the capability of lid nesting of multiple lids with interference fit between adjacent lids to lock the lids together. FIGS. 11A-11C illustrate two lids 70 stacked together. The outer skirt 72-3 of the lid 70 in the lid corners has a step or shoulder 72-3A, such that the lower portion 72-3B below the shoulder can be fitted over the outer skirt of another lid 70 and rest on the shoulder 72-3A of a lower lid in the stack. FIGS. 3C and 6C show the construction of the lid skirt in the corner regions. The skirt dimensions are selected such that there is an interference fit between the interior wall surface of skirt portion 72-3B and the outer wall surface of the skirt above the shoulder of a nested lid 70, to provide a frictional engagement between the respective lids. The interference dimension may be on the order of 0.010 inch for one exemplary embodiment, but the interference dimension may be different for other embodiments and applications. The interference may secure the lids in the nested configuration, thereby enhancing storage and shipping of lids.

While the exemplary embodiments of the lids and vessels have heretofore been described with respect to rectangular configurations, the features and aspects may be utilized with other configurations. For example, FIGS. 12A-12C illustrate two nested lids designed to fit vessels having a circular footprint configuration.

Figure 2E:
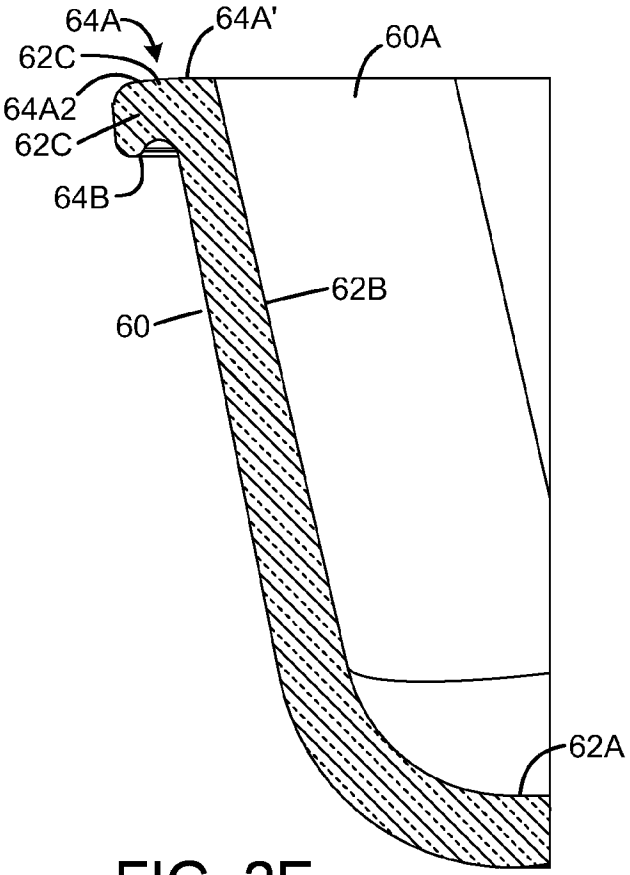
FIG. 2E is a cross-sectional view taken along line 2E-2E of FIG. 2D.

The lid 70 is designed for sealing attachment to vessels with a range of dimensional tolerances. The vessel rim as noted above includes a generally flat top rim surface, for example 64 (FIG. 2E). The top rim surface may be designed with a downward sloping outer edge portion 64A2. The inner edge portion 64A1 is preferably flat. Thus, moving away from the center of the lid, there is a downward slope of the surface 64A. This downward slope accommodates some misalignment of the lid to the vessel, and also some vessel tolerances, in regard to latching force. The latching force is determined by how much the seal compresses when the latches are closed. If the position of the latch hinge on the lid moves outwardly relative to the vessel rim, this would tend to increase the distance from the hinge to the vessel latch surface, and hence the latching force. However, the slope of the rim surface on the outer part of the rim allows the lid to move downwardly, so that the distance from the hinge to the vessel latch surface remains the same, or at least reducing an increase in this distance. The slope or curvature thus tends to reduce variations in the latching force due to vessel dimensional tolerances.

Figure 13:
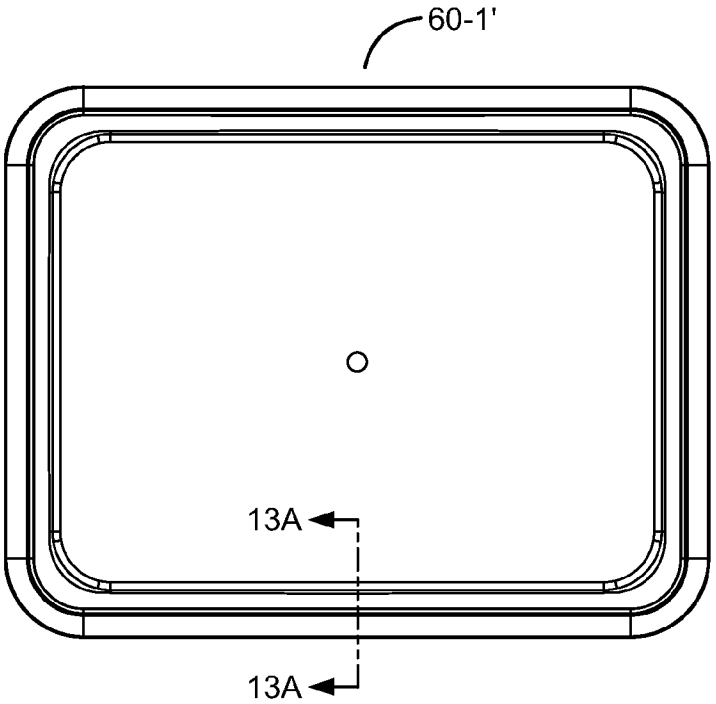
FIG. 13 is a top view of a plastic vessel.
Figure 13A:
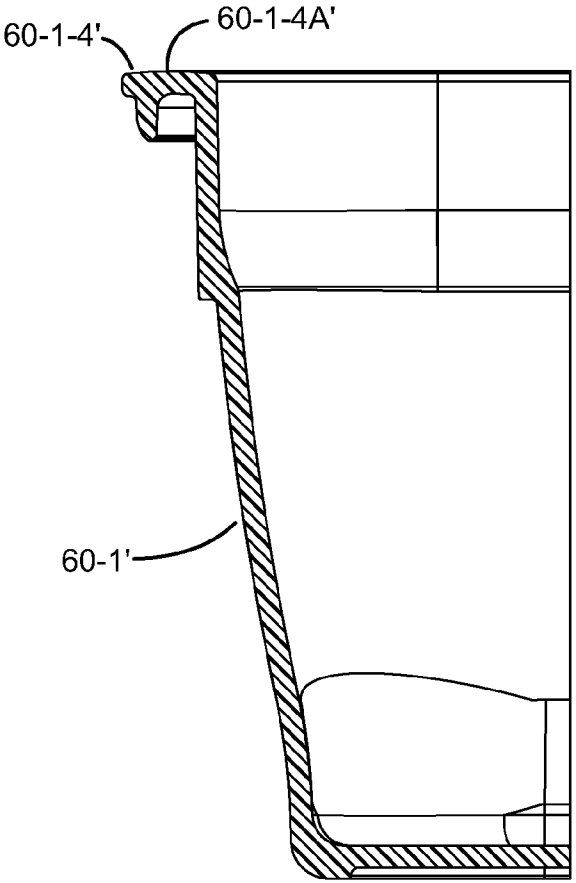
FIG. 13A is a cross-sectional view of the vessel of FIG. 13, taken along line 13A-13A of FIG. 13.

In another embodiment, the sealing surface at the rim of the vessel may be designed with a slight slope downwardly from the center of the sealing surface toward the center of the lid, as well as a slight slope downwardly in a direction away from the lid center. This embodiment can accomplish the same benefit in reducing variations in latching force whether the lid periphery is shifted inwardly or outwardly, either as a result of misalignment or manufacturing tolerances. FIGS. 13 and 13A illustrate this feature, in relation to a plastic vessel 60-1' with top rim 60-1-4' and sealing surface 60-1-4'. Here, the midpoint of the sealing surface is the highest point of the surface relative to the vessel base, and the sealing surface slopes downwardly in either direction from the midpoint.

A method of merchandising lids and vessels is described, and includes, in one embodiment:

a) providing for separate purchase by a consumer a lid having a universal capability to match to a plurality of vessels fabricated of different materials and having different manufacturing dimensional tolerances, each vessel having an open top surrounded by a peripheral edge portion, the lid including a lid portion fabricated of a plastic material, and a peripheral seal structure portion formed of an elastomeric material different from the plastic material of the lid portion, the seal structure portion integrated with the lid portion to form a unitary one-piece lid-seal structure wherein the seal structure portion is permanently attached to the lid portion, a set of latches integrated with the lid portion, the seal structure portion comprising a main body portion attached to the lid portion, a second seal portion comprising a protruding spring portion, and a third seal portion comprising a compression portion, the spring portion of the seal structure configured to flex to absorb flatness variability of a vessel sealing surface portion, while the compression portion is configured to provide adequate latch retention force to hold the lid latches in a closed position, and wherein the seal structure is configured to provide an air-tight seal between the lid portion and the sealing surface portion of the peripheral edge of the vessel when the lid is attached to the vessel; and b) providing for separate purchase by a consumer a plurality of vessels each configured to match to the lid, and wherein different ones of the vessels are fabricated of materials different from others of the plurality of vessels, and wherein the different materials have different manufacturing dimensional vessel tolerances.

In one embodiment of the merchandising method, a first one of the plurality of vessels is fabricated from a plastic, a second one of the plurality of vessels is fabricated from a glass, a third one of the plurality of vessels is fabricated from a metal, and a fourth one of the plurality of vessels is fabricated from a ceramic.

The different materials of the vessel are selected from the group comprising plastic, metal, ceramic and glass, in a further embodiment.

Although the foregoing has been a description and illustration of specific embodiments, various modifications and changes thereto can be made by persons skilled in the art without departing from the scope and spirit of the invention.

What is claimed is:

1. A method of merchandising lids and vessels, comprising a sequence of the following steps:

providing for separate purchase by a consumer of a lid having a universal capability to match to a plurality of vessels fabricated of different materials and having different manufacturing dimensional tolerances, each vessel having an open top region surrounded by a peripheral portion including a generally flat top edge portion and a latch engagement lip portion, the lid comprising:

a lid portion fabricated of a plastic material, and a peripheral seal structure portion formed of an elastomeric material different from said plastic material of the lid portion, the peripheral seal structure portion integrated with the lid portion to form a unitary one-piece lid-seal structure, wherein the peripheral seal structure portion is permanently attached to the lid portion;

a set of latches integrated with the lid portion by living hinges, each of said latches having a hook feature configured to engage the latch engagement lip portion of each of the plurality of vessels when the lip is placed on the vessel and the latch is rotated about the hinge to a latched position;

the peripheral seal structure portion comprising a main body portion attached to the lid portion, a second seal portion comprising a protruding spring portion, and a third seal portion comprising a compression portion, the protruding spring portion of the peripheral seal structure portion configured to flex as it is brought into contact with and to absorb flatness variability of the generally flat top edge portion, while the compression portion is configured to contact the generally flat edge portion and compress in response to latch closure to provide adequate latch retention force to hold the lid latches in the latched position; and wherein the peripheral seal structure portion is configured to provide an air-tight seal between the lid portion and the generally flat top edge portion of each of the plurality of vessels when the lid is attached to the vessel with the latches in the latched position; and providing for separate purchase by a consumer of the plurality of vessels each configured to match to the lid, each vessel a unitary structure having an open top region defined by a bottom portion, a sidewall portion and the peripheral rim portion, and wherein different ones of the vessels and their respective peripheral rim portions are fabricated of materials different from others of the plurality of vessels, and wherein the different materials of the plurality of vessels have different manufacturing dimensional vessel tolerances.

2. The method of claim 1, wherein a first one of said plurality of vessels is fabricated from a plastic, a second one of said plurality of vessels is fabricated from a glass, a third one of said plurality of vessels is fabricated from a metal, and a fourth one of said plurality of vessels is fabricated from a ceramic.

3. The method of claim 1, wherein said different materials of the plurality of vessels are selected from a group comprising plastic, metal, ceramic and glass.

4. The method of claim 1, wherein the plastic material is polypropylene, and the elastomeric material is a thermoplastic elastomer material.

5. The method of claim 1, wherein the seal structure material is a material adherent to the lid portion plastic material, and wherein the peripheral seal structure portion is fabricated as an injection molded second shot onto the lid portion.

6. The method of claim 1, wherein the lid is configured to attach to different vessels of different materials to provide an air-tight seal, and wherein the different materials include glass, ceramic, metal and plastic, whereby the lid attaches to a glass vessel to provide a first air-tight container system, to a plastic vessel to provide a second air-tight container system, to a ceramic vessel to provide a third air-tight container system, and to a metal vessel to provide a fourth container system.

7. A method of merchandising lids and vessels, comprising a sequence of the following steps:

providing for separate purchase by a consumer a lid having a universal capability to match to a plurality of vessels fabricated of different materials and having different manufacturing dimensional tolerances, each vessel having an open top surrounded by a peripheral edge portion, the lid comprising:

a lid portion fabricated of a plastic material, and a peripheral seal structure portion formed of an elastomeric material different from said plastic material of the lid portion, the peripheral seal structure portion integrated with the lid portion to form a unitary one-piece lid-seal structure, wherein the peripheral seal structure portion is permanently attached to the lid portion;

a set of latches integrated with the lid portion;

the peripheral seal structure portion comprising a main body portion attached to the lid portion, a second seal portion comprising a protruding spring portion, and a third seal portion comprising a compression portion at a distal end of the peripheral seal structure portion, the protruding spring portion of the peripheral seal structure portion when viewed in cross-section comprising a finger-like protrusion protruding from the compression portion at said distal end, and wherein the protruding spring seal portion is angled inwardly toward an interior portion of the lid or outwardly away from the interior portion of the lid and angularly away from the distal end with the lid in an unattached position relative to the vessel, wherein the seal structure portion extends about an entire outer periphery of a peripheral channel portion of the lid portion, the spring portion configured to flex as it is brought into contact with and to maintain sealing contact with a vessel sealing surface portion to absorb flatness variability of the vessel sealing surface portion, while the compression portion is configured to contact the vessel sealing surface portion and compress in response to latch closure and to provide adequate latch retention force to hold the lid latches in a closed position; and wherein the peripheral seal structure portion is configured to provide an air-tight seal between the lid portion and the vessel sealing surface portion of the peripheral edge portion of each of the plurality of vessels when the lid is attached to the vessel; and providing for separate purchase by a consumer the plurality of vessels each configured to match to the lid, and wherein different ones of the vessels are fabricated of materials different from others of the plurality of vessels, and wherein the different materials of the plurality of vessels have different manufacturing dimensional vessel tolerances.

8. The method of claim 7, wherein a first one of said plurality of vessels is fabricated from a plastic, a second one of said plurality of vessels is fabricated from a glass, a third one of said plurality of vessels is fabricated from a metal, and a fourth one of said plurality of vessels is fabricated from a ceramic.

9. The method of claim 7, wherein said different materials of the plurality of vessels are selected from a group comprising plastic, metal, ceramic and glass.

10. The method of claim 7, wherein the plastic material is polypropylene, and the elastomer material is a thermoplastic elastomer material.

11. The method of claim 7, wherein the seal structure material is a material adherent to the lid portion plastic material, and wherein the seal structure portion is fabricated as an injection molded second shot onto the lid portion.

12. The method of claim 7, wherein the lid is configured to attach to different vessels of different materials to provide an air-tight seal, and wherein the different materials include glass, ceramic, metal and plastic, whereby the lid attaches to a glass vessel to provide a first air-tight container system, to a plastic vessel to provide a second air-tight container system, to a ceramic vessel to provide a third air-tight container system, and to a metal vessel to provide a fourth container system.

* * * * *